US005330867A

United States Patent [19]

Hsiao et al.

[11] Patent Number: 5,330,867

[45] Date of Patent: Jul. 19, 1994

[54] PHOTOGENERATING TITANYL PHTHALOCYANINE AND PROCESSES THEREOF

[75] Inventors: Cheng-Kuo Hsiao; Ah-Mee Hor, both of Mississauga; James D. Mayo, Toronto; Giuseppa Baranyi, Mississauga, all of Canada; Gregory J. Kovacs, Sunnyvale, Calif.; Terry L. Bluhm, Pittsford, N.Y.; Zoran D. Popovic; B. W. Anissa Yeung, both of Mississauga, Canada

[73] Assignee: Xerox Corporation, Stamford, Conn.

[21] Appl. No.: 933,852

[22] Filed: Aug. 24, 1992

[51] Int. Cl.[5] ..... G03G 5/06

[52] U.S. Cl. ..... 430/76; 430/78; 430/130

[58] Field of Search ..... 430/56, 57, 58, 78, 430/135, 76, 130, 127; 540/141

[56] References Cited

U.S. PATENT DOCUMENTS

| | | | |
|---|---|---|---|
| 3,825,422 | 7/1974 | Gruber et al. | 96/1 PE |
| 4,471,039 | 9/1984 | Borsenberger et al. | 430/58 |
| 4,643,770 | 2/1987 | Hays | 106/23 |
| 4,664,997 | 5/1987 | Suzuki et al. | 430/58 |
| 4,898,799 | 2/1990 | Fujimaki et al. | 430/59 |
| 5,132,197 | 7/1992 | Iuchi et al. | 430/76 |

FOREIGN PATENT DOCUMENTS

| | | | |
|---|---|---|---|
| 0314100 | 5/1989 | European Pat. Off. . | |
| 63-218768 | 9/1988 | Japan | 430/78 |

*Primary Examiner*—John Goodrow
*Attorney, Agent, or Firm*—E. D. Palazzo

[57] ABSTRACT

A layered imaging member comprised of a photogenerating layer of titanyl phthalocyanine prepared by depositing amorphous titanyl phthalocyanine on a substrate maintained at a temperature of from below 25° to about minus 30° C.; and contacting the substrate product with an aliphatic alcohol.

24 Claims, No Drawings

PHOTOGENERATING TITANYL PHTHALOCYANINE AND PROCESSES THEREOF

BACKGROUND OF THE INVENTION

This invention is generally directed to photogenerating pigments such as titanyl phthalocyanines and processes for the preparation thereof, and more specifically, the present invention is directed to processes for obtaining titanyl phthalocyanine polymorphs or crystal forms, including the known Type IV, reference for example U.S. Pat. No. 4,898,799, the disclosure of which is totally incorporated herein by reference, Type X and layered photoconductive members comprised of the aforementioned titanyl phthalocyanine polymorphs, especially the Type IV and the Type X. In embodiments, the present invention is directed to a process for the preparation of titanyl phthalocyanines by the application of titanyl phthalocyanines to a cooled supporting substrate, like aluminum, and thereafter treating the substrate with a solvent, like an alcohol. In one embodiment, the present invention is directed to a process for the preparation of a high purity titanyl phthalocyanine, especially titanyl phthalocyanine Type IV, by applying titanyl phthalocyanine Type II to a substrate cooled to a temperature below 25° C., and preferably from between about −10° to about −30° C.; permitting the substrate to attain room temperature, about 25° C. and subsequently treating, for example, by dipping the substrate into an aliphatic alcohol with 1 to about 12 carbon atoms like methanol. Advantages associated with the processes of the present invention are the provision of a high purity titanyl phthalocyanine, especially Type IV, which purity ranges from about 95 to about 99.5 percent in embodiments, and wherein the titanyl phthalocyanine Type IV contains minimal, or substantially no Type If titanyl phthalocyanine; and superior photosensitivity for the titanyl phthalocyanine obtained, that is for example $E_{\frac{1}{2}}=0.8$ to 1.0 ergs/cm$^2$ at $\lambda=800$ nanometers as compared to a sensitivity of $E_{\frac{1}{2}}=1.3$ to 3.2 ergs/cm$^2$ at $\lambda=800$ nanometers for a number of prior art obtained titanyl phthalocyanines where, for example, the substrate temperature was retained above room temperature during the deposition. Layered imaging members with the aforementioned Type IV as a photogenerator, a charge transport, especially an aryl amine as illustrated herein, and a supporting substrate possess excellent photosensitivity. The titanyl phthalocyanines, especially the known polymorph IV and the X form, can be selected as organic photogenerator pigments in photoresponsive imaging members containing charge, especially hole transport layers such as known aryl amine hole transport molecules. The aforementioned photoresponsive imaging members can be negatively charged when the photogenerating layer is situated between the hole transport layer and the substrate, or positively charged when the hole transport layer is situated between the photogenerating layer and the supporting substrate. The layered photoconductive imaging members can be selected for a number of different known imaging and printing processes including, for example, electrophotographic imaging processes, especially xerographic imaging and printing processes wherein negatively charged or positively charged images are rendered visible with toner compositions of the appropriate charge. Generally, the imaging members are sensitive in the wavelength regions of from about 550 to about 850 nanometers, thus diode lasers can be selected as the light source. Titanyl phthalocyanines may also be selected as intense blue light stable colorants for use in coatings, such as paint, inks, and as near infrared absorbing pigments suitable for use as IR laser optical recording materials.

Titanyl phthalocyanines, including Type IV, as photogenerating pigments in layered photoconductive imaging members are known. The use of certain titanium phthalocyanine pigments as a photoconductive material for electrophotographic applications is known, reference for example British Patent Publication 1,152,655, the disclosure of which is totally incorporated herein by reference. Also, U.S. Pat. No. 3,825,422 illustrates the use of titanyl phthalocyanine as a photoconductive pigment in an electrophotographic process known as particle electrophoresis. Further, as mentioned in the textbook *Phthalocyanine Compounds* by Moser and Thomas, the disclosure of which is totally incorporated herein by reference, polymorphism or the ability to form distinct solid state forms is well known in phthalocyanines. For example, metal-free phthalocyanine is known to exist in at least 5 forms designated as alpha, beta, pi, X and tau. Copper phthalocyanine crystal forms known as alpha, beta, gamma, delta, epsilon and pi are also described. These different polymorphic forms are usually distinguishable on the basis of differences in the solid state properties of the materials which can be determined by measurements, such as Differential Scanning Calorimetry, Infrared Spectroscopy, Ultraviolet-Visible-Near Infrared spectroscopy and, especially, X-Ray Powder Diffraction techniques. There appears to be general agreement on the nomenclature used to designate specific polymorphs of commonly used pigments such as metal-free and copper phthalocyanine. However, this does not appear to be the situation with titanyl phthalocyanines as different nomenclature is selected in a number of instances. For example, reference is made to alpha, beta, A, B, C, y, and m forms of TiOPc (titanyl phthalocyanine) with different names being used for the same form in some situations. It is believed that five main crystal forms of TiOPc are known, that is Types I, II, III, X, and IV. In Japanese 62-256865 there is disclosed, for example, a process for the preparation of pure Type I involving the addition of titanium tetrachloride to a solution of phthalonitrile in an organic solvent which has been heated in advance to a temperature of from 160° to 300° C. In Japanese 62-256866, there is illustrated, for example, a method of preparing the aforementioned polymorph which involves the rapid heating of a mixture of phthalonitrile and titanium tetrachloride in an organic solvent at a temperature of from 100° to 170° C. over a time period which does not exceed one hour. In Japanese 62-256867, there is described, for example, a process for the preparation of pure Type II (B) titanyl phthalocyanine, which involves a similar method to the latter except that the time to heat the mixture at from 100° to 170° C., is maintained for at least two and one half hours. Types I and II, in the pure form obtained by the process of the above publications, apparently afforded layered photoresponsive imaging members with excellent electrophotographic characteristics.

In Mita EPO Patent Publication 314,100, there is illustrated the synthesis of TiOPc by, for example, the reaction of titanium alkoxides and diiminoisoindoline in quinoline or an alkylbenzene, and the subsequent conversion thereof to an alpha type pigment (Type II) by an acid pasting process, whereby the synthesized pigment is dissolved in concentrated sulfuric acid, and the resultant solution is poured onto ice to precipitate the alpha-form, which is filtered and washed with methylene chloride. This pigment, which was blended with varying amounts of metal free phthalocyanine, could be selected as the electric charge generating layer in layered photoresponsive imaging members with a high photosensitivity at, for example, 780 nanometers.

In Mitsubishi Laid Open Japanese Application 90-269776, laid open date Nov. 5, 1990, the disclosure of which is totally incorporated herein by reference, there is illustrated the preparation of titanyl phthalocyanines by the treatment of phthalocyanines, such as metal free, metal phthalocyanines, or their derivatives with solvents containing at least trifluoroacetic acid, or mixed solvents of trifluoroacetic acid and halogenated hydrocarbons such as methylene chloride. In Example I of this Japanese Laid Open Application the preparation of the C-form of TiOPc is described. Other forms obtained are described in Examples II and III.

Processes for the preparation of specific polymorphs of titanyl phthalocyanine, which require the use of a strong acid such as sulfuric acid, are known, and these processes, it is believed, are not easily scalable. One process as illustrated in Konica Japanese Laid Open on Jan. 20, 1989 as 64-17066 (U.S. Pat. No. 4,643,770 appears to be its equivalent), the disclosure of which is totally incorporated herein by reference, involves, for example, the reaction of titanium tetrachloride and phthalonitrile in 1-chloronaphthalene solvent to produce dichlorotitanium phthalocyanine which is then subjected to hydrolysis by ammonia water to enable the Type II polymorph. This phthalocyanine is preferably treated with an electron releasing solvent such as 2-ethoxyethanol, dioxane, N-methylpyrrolidone, followed by subjecting the alpha-titanyl phthalocyanine to milling at a temperature of from 50° to 180° C. In a second method described in the aforementioned Japanese Publication, there is disclosed the preparation of alpha type titanyl phthalocyanine with sulfuric acid. Another method for the preparation of Type IV titanyl phthalocyanine involves the addition of an aromatic hydrocarbon, such as chlorobenzene solvent to an aqueous suspension of Type II titanyl phthalocyanine prepared by the well known acid pasting process, and heating the resultant suspension to about 50° C. as disclosed in Sanyo-Shikiso Japanese 63-20365, Laid Open in Jan. 28, 1988. In Japanese 171771/1986, Laid Open Aug. 2, 1986, there is disclosed the purification of metallophthalocyanine by treatment with N-methylpyrrolidone. Other prior art includes Japanese Publications 62-67044, 63-20354, 120564 and 228265; and U.S. Pat. Nos. 4,664,997 and 4,898,799.

To obtain a TiOPc-based photoreceptor having high sensitivity to near infrared light, it is believed necessary to control not only the purity and chemical structure of the pigment, as is generally the situation with organic photoconductors, but also to prepare the pigment in the correct crystal modification. The disclosed processes used to prepare specific crystal forms of TiOPc, such as Types I, II, III and IV, are either complicated and difficult to control as in the preparation of pure Types I and II pigments by careful control of the synthesis parameters by the processes described in Mitsubishi Japanese 62-25685,-6 and -7, or involve harsh treatment such as sand milling at high temperature, reference Konica U.S. Pat. No. 4,898,799; or dissolution of the pigment in a large volume of concentrated sulfuric acid, a solvent which is known to cause decomposition of metal phthalocyanines, reference Sanyo-Shikiso Japanese 63-20365, and Mita EPO 314,100.

Generally, layered photoresponsive imaging members are described in a number of U.S. patents, such as U.S. Pat. No. 4,265,900, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, titanyl phthalocyanines, and metal free phthalocyanines.

In copending application U.S. Ser. No. 537,714 (D/90087), the disclosure of which is totally incorporated herein by reference, there are illustrated photoresponsive imaging members with photogenerating titanyl phthalocyanine layers prepared by vacuum deposition. It is indicated in this copending application that the imaging members comprised of the vacuum deposited titanyl phthalocyanines and aryl amine hole transporting compounds exhibit superior xerographic performance as low dark decay characteristics result and higher photosensitivity is generated, particularly in comparison to several prior art imaging members prepared by solution coating or spray coating, reference for example U.S. Pat. No. 4,429,029 mentioned hereinbefore.

In U.S. Pat. No. 5,153,313 (D/90244), the disclosure of which is totally incorporated herein by reference, there is illustrated a process for the preparation of phthalocyanine composites which comprises adding a metal free phthalocyanine, a metal phthalocyanine, a metalloxy phthalocyanine or mixtures thereof to a solution of trifluoroacetic acid and a haloalkane; adding to the resulting mixture a titanyl phthalocyanine; adding the resulting solution to a mixture that will enable precipitation of said composite; and recovering the phthalocyanine composite precipitated product.

In U.S. Pat. No. 5,166,339 (D/90198), the disclosure of which is totally incorporated herein by reference, there is illustrated a process for the preparation of titanyl phthalocyanine which comprises the reaction of titanium tetrapropoxide with diiminoisoindoline in N-methylpyrrolidone solvent to provide Type I, or $\beta$-type titanyl phthalocyanine as determined by X-ray powder diffraction; dissolving the resulting titanyl phthalocyanine in a mixture of trifluoroacetic acid and methylene chloride; adding the resulting mixture to a stirred organic solvent, such as methanol, or to water; separating the resulting precipitate by, for example, vacuum filtration through a glass fiber paper in a Buchner funnel; and washing the titanyl phthalocyanine product.

Disclosed in U.S. Pat. No. 5,198,155 (D/91153) entitled "Titanium Phthalocyanines and Processes for the Preparation Thereof" with inventors James D. Mayo, Terry L. Bluhm, Cheng K. Hsiao, Trevor I. Martin and Ah-Mee Hor; and U.S. Pat. No. 5,182,382 (D/91154) entitled "Processes for Titanyl Phthalocyanines" with inventors James D. Mayo, James M. Duff, Trevor I. Martin, Terry L. Bluhm, Cheng K. Hsiao and Ah-Mee Hor, is a process for the preparation of titanyl phthalocyanine which comprises the treatment of titanyl phthalocyanine Type X with a halobenzene, the disclosures of which are totally incorporated herein by reference.

In U.S. Pat. No. 5,206,359 (D/91151), the disclosure of which is totally incorporated herein by reference, are processes for the preparation of titanyl phthalocyanine (TiOPc) polymorphs, which comprises, for example, the solubilization of a titanyl phthalocyanine Type I in a mixture of trifluoroacetic acid and methylene chloride, adding the resulting mixture slowly, for example dropwise, to an aliphatic alcohol with from 1 to about 12 carbon atoms, such as methanol, ethanol, propanol, butanol, and the like; precipitation of the desired titanyl phthalocyanine, such as Type X, separation by, for example, filtration, and optionally subjecting the product to washing, and thereafter treating the Type X titanyl phthalocyanine obtained with a halo, such as a chlorobenzene, to obtain Type IV titanyl phthalocyanine. The product can be identified by various known means including X-ray powder diffraction (XRPD).

The disclosures of all of the aforementioned publications, laid open applications, copending applications and patents are totally incorporated herein by reference.

SUMMARY OF THE INVENTION

It is an object of the present invention to provide processes for the preparation of titanyl phthalocyanines with many of the advantages illustrated herein.

It is yet another object of the present invention to provide processes for the preparation of Type IV titanyl phthalocyanine by the deposition of amorphous titanyl phthalocyanine on a substrate cooled to a temperature of below 2° C., and preferably below 0° C.

Further, another object of the present invention is to provide processes for the preparation of Type IV titanyl phthalocyanine by the deposition of amorphous titanyl phthalocyanine on a substrate cooled to a temperature in the range of minus 10° to about minus 30° C., and subsequently contacting the product obtained with a solvent, like an aliphatic alcohol, thereby enabling Type IV with a high purity, for example 95 to 99.95 percent, which phthalocyanine is substantially free of Type II phthalocyanine, and other impurities, and which Type IV exhibits excellent high photosensitivity in a layered imaging member.

Moreover, another object of the present invention is to provide processes for the preparation of Type IV titanyl phthalocyanine by the deposition of amorphous titanyl phthalocyanine on a substrate like aluminized MYLAR TM cooled to a temperature in the range of minus 10° to about minus 30° C., and subsequently contacting the product obtained with a solvent, like methanol, and wherein the starting titanyl phthalocyanine, before deposition, is subjected to known train sublimination purification processes, reference U.S. Pat. No. 4,937,164, the disclosure of which is totally incorporated herein by reference prior to deposition.

A further object of the present invention resides in the provision of photoresponsive imaging members including hybrid photoreceptors with an aryl amine hole transport layer, and a photogenerator layer comprised of the titanyl phthalocyanine pigments Type IV obtained with the processes illustrated herein, and which phthalocyanines in embodiments possess an $E_{\frac{1}{2}}$ of about 1 erg/cm$^2$ at 801 nanometers and a Bragg angle ($2\theta$) of 27.3 degrees.

These and other objects of the present invention can be accomplished in embodiments thereof by the provision of processes for the preparation of titanyl phthalocyanines and photoresponsive imaging members thereof. More specifically, in one embodiment of the present invention there are provided processes for the preparation of titanyl phthalocyanine (TiOPc) polymorphs, especially the Type IV crystalline form, which comprises depositing amorphous titanyl phthalocyanine on a substrate maintained at a temperature of below 25° C., and more specifically from about −10° to about −30°, and preferably −30° C.; permitting the aforementioned substrate with titanyl phthalocyanine to attain room temperature, about 25° C.; and contacting the substrate with a solvent, such as an aliphatic alcohol, whereby titanyl phthalocyanine Type IV with minimal impurities result.

In embodiments of the present invention, there are provided processes for the preparation of titanyl phthalocyanine (TiOPc) polymorphs, especially the Type IV crystalline form, which comprises vacuum depositing amorphous titanyl phthalocyanine thin films on a substrate maintained at a temperature of below 25°, and more specifically from about 0° to about −30°, and preferably −10° to −30° C. The substrate holder is equipped with a cooling and an electrically heating unit and coupled with a temperature control unit. Titanyl phthalocyanine powder was electrically heated in a crucible. The pressure of the vacuum chamber is at about $5\times10^{-6}$ to about $1\times10^{-7}$ mbar. The deposition rate was controlled at 8 to 10 Angstroms/second and the thickness of the deposited film could be 200 to 3,000 Angstroms. The resulting film was slowly warming up in vacuum until the aforementioned substrate with titanyl phthalocyanine attains room temperature, about 25° C. Thereafter, the film was removed from the vacuum chamber and this film was immersed in a solvent, such as an aliphatic alcohol, like methanol, ethanol, propanol, butanol, and the like, a ketone, a water mixture of the aforementioned solvents, or a water mixture of an acid at 25° to 70° C. for 10 seconds to about 10 hours. The film was then rinsed with water and dried under ambient conditions. The Type IV titanyl phthalocyanine films obtained exhibited an optical absorption spectrum with $\lambda_{max}$=780 to 800 nanometers and an X-ray powder diffraction pattern with a characteristic Bragg peak at 27.3° $2\theta$) angle. Methanol treatment of the vacuum deposited TiOPc film at −30° C. provided Type IV titanyl phthalocyanine with minimal impurities of Type II titanyl phthalocyanine. With the substrate temperature at 90° C. (higher than 25° C.) the vacuum deposited TiOPc film contains Type II titanyl phthalocyanine impurity which can adversely effect the photoconductive characteristics thereof. The optical absorption spectrum and X-ray powder diffraction pattern indicate that Type II TiOPc is present.

In an embodiment, the xerographic characteristics of a layered imaging member with a titanyl phthalocyanine Type IV photogenerator obtained with the process of the present invention, an aryldiamine charge transport molecule dispersed in a polymeric binder as the top layer, and a metallized plastic substrate, such as aluminized MYLAR TM, in contact with the photogenerating layer were $E_{\frac{1}{2}}$=0.8 to 1.2 ergs/cm$^2$, dark decay=10 to 40 volts/second, and a discharge at 5 and 10 ergs/cm$^2$ of 85 to 90 and 88 to 92 percent, respectively.

Type I titanyl phthalocyanine can be prepared by the reaction of titanium tetraalkoxide, especially the tetrabutoxide with diiminoisoindoline in a chloronaphthalene solvent to provide crude Type I titanyl phthalocyanine, which is subsequently washed with a component such as dimethylformamide to provide a pure form of Type I as determined by X-ray powder diffraction.

For the preparation of Type I titanyl phthalocyanine the process comprises the reaction of $DI^3$ (1,3-diiminoisoindoline) and titanium tetrabutoxide in the presence of 1-chloronaphthalene solvent, whereby there is obtained a crude titanyl phthalocyanine Type I, which is subsequently purified, up to about a 99.5 percent purity, by washing with, for example, dimethylformamide.

Type I titanyl phthalocyanine can also be prepared by 1) the addition of 1 part titanium tetrabutoxide to a stirred solution of from about 1 part to about 10 parts and preferably about 4 parts of 1,3-diiminoisoindoline; 2) relatively slow application of heat using an appropriate sized heating mantle at a rate of about 1 degree per minute to about 10 degrees per minute and preferably about 5 degrees per minute until refluxing occurs at a temperature of about 130 degrees to about 180 degrees; 3) removal and collection of the resulting distillate, which was shown by NMR spectroscopy to be butyl alcohol, in a dropwise fashion, using an appropriate apparatus, such as a Claisen Head condenser, until the temperature of the reactants reaches from 190 degrees to about 230 degrees (all temperatures are in Centigrade unless otherwise indicated) and preferably about 200 degrees; 4) continued stirring at said reflux temperature for a period of about ½ hour to about 8 hours and preferably about 2 hours; 5) cooling of the reactants to a temperature of about 130 degrees to about 180 degrees, and preferably about 160 degrees, by removal of the heat source; 6) filtration of the flask contents through, for example, an M-porosity (10 to 15 μm) sintered glass funnel which was preheated using a solvent which is capable of raising the temperature of said funnel to about 150 degrees, for example, boiling N,N-dimethylformamide in an amount sufficient to completely cover the bottom of the filter funnel so as to prevent blockage of said funnel; 7) washing the resulting purple solid by slurrying said solid in portions of boiling DMF either in the funnel or in a separate vessel in a ratio of about 1 to about 10, and preferably about 3 times the volume of the solid being washed, until the hot filtrate became light blue in color; 8) cooling and further washing the solid of impurities by slurrying said solid in portions of N,N-dimethylformamide at room temperature, about 25 degrees, approximately equivalent to about three times the volume of the solid being washed, until the filtrate became light blue in color; 9) washing the solid of impurities by slurrying said solid in portions of an organic solvent, such as methanol, acetone, water and the like, and in this embodiment methanol, at room temperature, about 25 degrees, approximately equivalent to about three times the volume of the solid being washed, until the filtrate became light blue in color; 10) oven drying the purple solid in the presence of a vacuum or in air at a temperature of from about 25 degrees to about 200 degrees, and preferably about 70 degrees, for a period of from about 2 hours to about 48 hours and preferably about 24 hours thereby resulting in the isolation of a shiny purple solid which was identified as being Type ]: titanyl phthalocyanine by its X-ray powder diffraction pattern.

Titanyl phthalocyanine can also be prepared by the reaction of diiminoisoindoline in a ratio of from 3 to 5 molar equivalents with 1 molar equivalent of titanium tetrabutoxide in a chloronaphthalene solvent in a ratio of from about 1 part diiminoisoindoline to from about 5 to about 10 parts of solvent. These ingredients are stirred and warmed to a temperature of from about 160° to about 240° C. for a period of from about 30 minutes to about 8 hours. After this time, the reaction mixture is cooled to a temperature of from about 100° to about 160° C. and the mixture is filtered through a sintered glass funnel (M porosity). The titanyl phthalocyanine Type I pigment obtained is washed in the funnel with boiling dimethyl formamide (DMF) solvent in an amount, which is sufficient to remove all deeply colored impurities from the solid, as evidenced by a change in the color of the filtrate from an initial black color to a faint blue green. Following this, the pigment is stirred in the funnel with boiling DMF in a sufficient quantity to form a loose suspension, and this is refiltered. The solid is finally washed with DMF at room temperature, then with a small amount of methanol and is finally dried at about 70° C. for from about 2 to about 24 hours. Generally, an amount of DMF equal to the amount of solvent (chloronaphthalene) used in the synthesis reaction is required for the washing step. The yield from this synthesis is from 60 to about 80 percent. X-ray powder diffraction, XRPD, analysis of the product thus obtained indicated that it was the Type I polymorph of titanyl phthalocyanine.

Titanyl phthalocyanines obtained can be further purified using the small-scale train-sublimation apparatus described in the *Journal of Materials Science,* 17, 2781 (1982), the disclosure of which is totally incorporated herein by reference. Samples were placed at the hot end of a glass tube (50 centimeters in length×25 millimeters), and nitrogen gas at a pressure of 2 millibar was allowed to pass over the sample toward the cold end. The glass tube was placed in a steel tube which was heated at one end and cooled at the other so that a temperature gradient of 100° to 550° C. formed along the length of the tube. The sublimate crystallized within a temperature zone which depended on the volatility of the pigment. Example II is illustrative of this general technique. The purified titanyl phthalocyanine was identified as the Type II polymorph which is further used for vacuum deposition.

Numerous different layered photoresponsive imaging members with the phthalocyanine pigments, especially Type IV, obtained by the processes of the present invention can be fabricated. In one embodiment, thus the layered photoresponsive imaging members are comprised of a supporting substrate, a charge transport layer, especially an aryl amine hole transport layer, and situated therebetween a photogenerator layer comprised of titanyl phthalocyanine of Type IV. Another embodiment of the present invention is directed to positively charged layered photoresponsive imaging members comprised of a supporting substrate, a charge transport layer, especially an aryl amine hole transport layer, and as a top overcoating titanyl phthalocyanine pigment Type IV obtained with the processes of the present invention. Moreover, there is provided in accordance with the present invention an improved negatively charged photoresponsive imaging member comprised of a supporting substrate, a thin adhesive layer, a titanyl phthalocyanine Type IV photogenerator obtained by the processes of the present invention vacuum deposited thin film at low substrate temperature, and as a top layer aryl amine hole transporting molecules dispersed in a polymeric resinous binder.

Imaging members with the titanyl phthalocyanine pigments of the present invention, especially Type IV, are useful in various electrophotographic imaging and printing systems, particularly those conventionally known as xerographic processes. Specifically, the imaging members of the present invention are useful in xerographic imaging processes wherein the titanyl phthalocyanine pigments absorb light of a wavelength of from about 600 nanometers to about 900 nanometers. In these known processes, electrostatic latent images are initially formed on the imaging member followed by development, and thereafter transferring the image to a suitable substrate.

Moreover, the imaging members of the present invention can be selected for electronic printing processes with various diode lasers, He-Ne light emitting diode (LED) and gallium arsenide light emitting diode arrays which typically function at wavelengths of from 660 to about 830 nanometers.

DETAILED DESCRIPTION OF THE INVENTION

A photoresponsive imaging member of the present invention can be comprised, in the order stated, of a substrate, thereover an adhesive layer, a photogenerator layer comprised of the Type IV titanyl phthalocyanine obtained by the process of the present invention, and a charge carrier hole transport layer comprised of an aryl amine such as N,N'-diphenyl-N,N'-bis(alkylphenyl)-1,1-biphenyl-4,4'-diamine dispersed in a polycarbonate resinous binder. Also, a photoresponsive imaging member can be selected in which the hole transport layer is situated between the supporting substrate and the photogenerating layer. More specifically, this photoconductive imaging member can be comprised, in the order stated, of a supporting substrate, a hole transport layer comprised of an aryl amine such as N,N'-diphenyl-N,N'-bis(alkylphenyl)-1,1-biphenyl-4,4'-diamine dispersed in an inactive resinous binder composition, and a photogenerating layer thereover comprised of Type IV titanyl phthalocyanine or other suitable titanyl phthalocyanines obtained by the process of the present invention illustrated herein which phthalocyanine can be a vacuum deposited and solvent treated thin film.

Substrate layers selected for the processes and imaging members of the present invention can be opaque or substantially transparent, and may comprise any suitable material having the requisite mechanical properties. Thus, the substrate may comprise a layer of insulating material including inorganic or organic polymeric materials, such as MYLAR ® a commercially available polymer, MYLAR ® containing titanium, a layer of an organic or inorganic material having a semiconductive surface layer such as indium tin oxide, or aluminum arranged thereon, or a conductive material inclusive of aluminum, titanium, chromium, nickel, brass or the like. The substrate may be flexible, seamless, or rigid and many have a number of many different configurations, such as for example a plate, a cylindrical drum, a scroll, an endless flexible belt and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON ®.

The thickness of the substrate layer depends on many factors, including economic considerations, thus this layer may be of substantial thickness, for example over 3,000 microns; or of minimum thickness providing there are no adverse effects on the system. In one embodiment, the thickness of this layer is from about 75 microns to about 300 microns.

With further regard to the imaging members, the photogenerator layer is preferably comprised of the titanyl phthalocyanine pigments obtained with the processes of the present invention including, for example, vacuum deposited thin films thereof. Generally, the thickness of the photogenerator layer depends on a number of factors, including the deposition rate and the pressure of the vacuum chamber. Accordingly, this layer can be of a thickness of from about 0.02 micron to about 0.3 micron. The maximum thickness of this layer in an embodiment is dependent primarily upon factors, such as photosensitivity, electrical properties and mechanical considerations. In embodiments of the present invention, it is desirable to select solvents that do not effect the other coated layers of the device. Examples of solvents useful for the TiOPc to form a Type IV titanyl phthalocyanine photogenerator layer are ketones, alcohols, aromatic hydrocarbons, halogenated aliphatic hydrocarbons, ethers, amines, amides, esters, acids, water, as well as mixtures of the aforementioned solvents, and the like. Specific examples are acetone, cyclohexanone, methyl ethyl ketone, methanol, ethanol, butanol, amyl alcohol, benzyl alcohol, toluene, xylene, chlorobenzene, carbon tetrachloride, chloroform, methylene chloride, trichloroethylene, tetrahydrofuran, dioxane, diethyl ether, dimethylformamide, dimethylacetamide, butyl acetate, ethyl acetate and methoxyethyl acetate, acetic acid, trifluoroacetic acid, trichloroacetic acid, tribromoacetic acid, and the like.

As adhesives, preferably situated between the supporting substrate and the photogenerating layer, there can be selected various known substances inclusive of polyesters, polyamides, poly(vinyl butyral), poly(vinyl alcohol), polyurethane and polyacrylonitrile. This layer is of a thickness of from about 0.05 micron to 1 micron. Optionally, this layer may contain conductive and nonconductive particles such as zinc oxide, titanium dioxide, silicon nitride, carbon black, and the like to provide, for example, in embodiments of the present invention desirable electrical and optical properties.

Aryl amines selected for the hole transporting layer which generally is of a thickness of from about 5 microns to about 75 microns, and preferably of a thickness of from about 10 microns to about 40 microns, include molecules of the following formula:

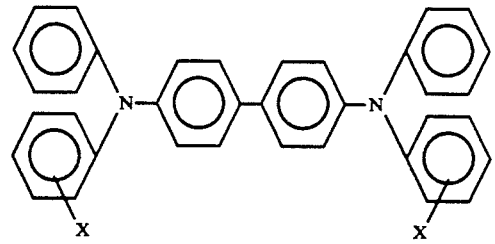

dispersed in a highly insulating and transparent organic resinous binder wherein X is an alkyl group or a halogen, especially those substituents selected from the group consisting of (ortho) $CH_3$, (para) $CH_3$, (ortho) Cl, (meta) Cl, and (para) Cl.

Examples of specific aryl amines are N,N'-diphenyl-N,N'-bis(alkylphenyl)-1,1-biphenyl-4,4'-diamine wherein alkyl is select from the group consisting of methyl, such as 2-methyl, 3-methyl and 4-methyl, ethyl, propyl, butyl, hexyl, and the like. With chloro substitution, the amine is N,N'-diphenyl-N,N'-bis(halo phenyl)-1,1'-biphenyl-4,4'-diamine wherein halo is 2-chloro, 3-chloro or 4-chloro. Other known hole transporting compounds can be selected. Other known charge transport layer molecules can be selected, reference for example U.S. Pat. Nos. 4,921,773 and 4,464,450, the disclosures of which are totally incorporated herein by reference.

Examples of the highly insulating and transparent resinous material or inactive binder resinous material for the transport layers include materials such as those described in U.S. Patent 3,121,006, the disclosure of which is totally incorporated herein by reference. Specific examples of organic resinous materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the resinous binder contains from about 10 to about 75 percent by weight of the active material corresponding to the foregoing formula, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The invention will now be described in detail with reference to specific preferred embodiments thereof, it being understood that these Examples are intended to be illustrative only. The invention is not intended to be limited to the materials, conditions, or process parameters recited herein, it being noted that all parts and percentages are by weight unless otherwise indicated. Comparative data and Examples are also presented.

EXAMPLE I

Synthesis of Type I Titanyl Phthalocyanine:

A 250 milliliter three-necked flask fitted with mechanical stirrer, condenser and thermometer maintained under an atmosphere of argon was charged with 1,3-diiminoisoindoline (14.5 grams - 0.1 mole), titanium tetrabutoxide (8.5 grams - 0,025 mole; available from Aldrich) and 75 milliliters of 1-chloronaphthalene. The mixture was then stirred and warmed. At 140° C. the mixture turned dark green and began to reflux. At this time, the vapor (this was identified as n-butanol by gas chromatography) was allowed to escape to the atmosphere until the reflux temperature reached 200° C. The reaction was maintained at this temperature for two hours then was cooled by removal of the heat source to 150° C. The product was filtered through a 150 milliliter M-porosity sintered glass funnel which was preheated to approximately 150° C. with boiling DMF, (dimethylformamide) and then washed thoroughly with three portions of 100 milliliters of boiling DMF, followed by three portions of 100 milliliters of DMF at room temperature, and then three portions of 50 milliliters of methanol, thus providing 10.3 grams (72 percent yield) of a shiny purple pigment which was identified as Type I TiOPc by XRPD.

A 1 liter three-necked flask fitted with mechanical stirrer, Claisen Head condenser and thermometer maintained under an atmosphere of argon was charged with diiminoisoindoline (94.3 grams, 0.65 mole), titanium tetrabutoxide (55.3 grams, 0.1625 mole; available from Aldrich) and 650 milliliters of 1-chloronaphthalene. The mixture was stirred and warmed. At about 140° C. the mixture turned dark green and began to reflux. At this time the Claisen Head stopcock was opened and the vapor (this was identified as n-butanol by gas chromatography) was allowed to escape in a dropwise manner until the reflux temperature reached 200° C. The reaction was maintained at about this temperature for two hours then was cooled by removal of the heat source to 150° C. Filtration using a 1 liter sintered glass funnel and washing with 3×1 liter portions of boiling DMF, 3×1 liter portions of DMF at room temperature, about 25° C., then 3×1 liter portions of methanol, provided 69.7 grams (74 percent yield) of blue pigment which was identified as Type I TiOPc by XRPD.

The elemental analysis of the above obtained Type I product was: C, 67.38; H, 2.78; N, 19.10; Ash, 13.61. TiOPc requires: C, 66.67; H, 2.80; N, 19.44; Ash, 13.61.

Purification of Pigments by Train Sublimation:

Titanyl phthalocyanine were purified using the small-scale train-sublimation apparatus described in the *Journal of Materials Science,* 17,2781 (1982), the disclosure of which is totally incorporated herein by reference. Samples were placed at the hot end of glass tube (50 centimeters in length×25 millimeters), and nitrogen gas at a pressure of 2 millibars was allowed to pass over the sample toward the cold end. The glass tube was placed in a steel tube which was heated at one end and cooled at the other so that a temperature gradient of 100° to 550° C. formed along the length of the tube. The sublimate crystallized within a temperature zone which depended primarily on the volatility of the pigment. Example II is illustrative of this general technique.

EXAMPLE II

Train Sublimation of Titanyl Phthalocyanine:

Sublimation of a 2.0 gram sample of the titanyl phthalocyanine of Example I at 2 millibars using a hot zone temperature of 535° C. afforded 1.4 grams of purified sublimed material as shiny purple crystals. This material condensed at temperatures of between 375° and 275° C. The purified titanyl phthalocyanine identified by NMR as Type II polymorph and was subsequently used for vacuum deposition. Spectroscopic analysis of the products evidenced no detectable impurities.

EXAMPLE III

Vacuum Deposition of TiOPc:

Photoresponsive imaging members were prepared by providing for each separated member a titanized MYLAR TM substrate of 75 microns with a silane layer (gamma-aminopropyl methyl diethoxysilane) 0.1 micron in thickness thereover, a polyester adhesive layer thereon in a thickness of 0.1 micron, and depositing thereover in a Vacuum Generator (VG) UHV system a photogenerating layer of titanyl phthalocyanine pigments. The photogenerating layer had a final thickness of 0.15 micron. More specifically, 0.25 gram of Type I or II TiOPc, prepared as described in Example I or II was placed into a quartz crucible used for vacuum deposition. Each of the photogenerator components were evaporated from an electrically heated quartz crucible and the vacuum coater was evacuated to a pressure of $1\times10^{-6}$ millibar. The photogenerator layer was deposited at a rate of 6 to 10 Angstroms/second onto the adhesive layer. The liquid-nitrogen-cooled and electrically heated temperature-controlled sample holder was incorporated into this system. Acceptable thermal contact was maintained between the holder and glass slide or MYLAR ® with the aid of vacuum grease. The temperature range can be controlled between −150° C. and 240° C.

EXAMPLE IV 0.25 Gram of TiOPc prepared as described in Example II was used for vacuum deposition onto a predescribed titanium metallized MYLAR ® substrate at a substrate temperature of −30° C. according to Example III. The film was then immersed in methanol at room temperature (25° C.) over 60 minutes. After drying in ambient conditions, the amine charge transport layers were then coated onto the above photogenerator layer. Hole transporting layer solutions were prepared by dissolving 5.4 grams of N,N'-diphenyl-N,N-bis(3-methyl phenyl)-1,1'-biphenyl-4,4'-diamine, and 8.1 grams of polycarbonate in 57.6 grams of chlorobenzene. The solution was coated onto the TiOPc generator layer using a 10 mil film applicator. The charge transporting layer thus obtained was dried at 115° C. for 60 minutes to provide a final thickness of about 27 microns.

The xerographic electrical properties of a photoresponsive imaging member prepared as described above were determined by electrostatically charging the surface thereof with a corona discharge source until the surface potential, as measured by a capacitatively coupled probe attached to an electrometer, attained an initial dark value, $V_O$, of −800 volts. After resting for 0.5 second in the dark, the charged member reached a surface potential, $V_{ddp}$, or dark development potential. The member was then exposed to filtered light from a Xenon lamp. A reduction in surface potential from $V_{ddp}$ to a background potential, $V_{bg}$, due to the photodischarge effect, was observed. The dark decay in volts per second was calculated as $(V_O-V_{ddp})/0.5$. The percent of photodischarge was calculated as $100\times(V_{ddp}-V_{bg})/V_{ddp}$. The half exposure energy, $E_{\frac{1}{2}}$, the required exposure energy causing reduction of the $V_{ddp}$ to half of its initial value, was determined. The wavelength of light selected for our measurements was 800 nanometers. Xerographic electricals were shown in Table 1. This imaging member had a dark decay of 34 volts per second, and $E_{\frac{1}{2}}=0.8$ erg/cm$^2$. Discharge at 5 and 10 ergs/cm2 was 85 and 88 percent, respectively.

EXAMPLE V

A 1,000 Angstrom film of TiOPc was evaporated onto the glass substrate which was retained at −30° C. according to Example III. The optical absorption spectrum and XRD pattern of this film indicated that the deposited film was amorphous. After immersing the film in methanol at 25° C. for 60 minutes, the optical absorption spectrum and XRD pattern of the film was obtained. The methanol treatment has converted the amorphous film to Type IV polymorph with a strong peak at 27.3° 2θ in the XRD pattern.

EXAMPLE VI

An electrophotographic photoreceptor similar to the one in Example IV was fabricated except that substrate temperature was maintained at 0° C. Xerographic electricals are shown in Table 1.

COMPARATIVE EXAMPLE I

An electrophotographic photoreceptor similar to the one in Example IV was fabricated except that substrate temperature was maintained at 25° C. Xerographic electricals are shown in Table 1.

COMPARATIVE EXAMPLE II

An electrophotographic photoreceptor similar to the one in Example IV was fabricated except that substrate temperature was controlled at 90° C. Xerographic electricals are shown in Table 1.

COMPARATIVE EXAMPLE III

A 1,000 Angstrom film of TiOPc was evaporated onto the glass substrate which was kept at 90° C. according to Example III. A Type II polymorph with a strong peak at 7.5° 2θ in the XRD pattern is present in the film as determined by optical absorption spectrum and the XRD pattern of this film.

Table 1 summarizes the xerographic electricals of the aforementioned imaging members. The dark decay and photosensitivity (λ=800 nanometers) values are listed. For xerographic applications, the titanyl phthalocyanine films obtained at lower substrate temperature (lower than 25° C.) exhibit superior xerographic electrical properties and higher photosensitivity than the films deposited at higher substrate temperature (higher than 25° C.).

EXAMPLE VII

A 1,000 Angstrom film of TiOPc was prepared in accordance with Example III. The TiOPc was evaporated onto the glass substrate which temperature is maintained at −10° C. The thin film XRPD pattern and UV-Vis optical absorption spectrum are similar to Example VI.

EXAMPLE VIII

Acetic Acid/$H_2O$ Solvent Treatment:

A film similar to the one in Example VII with the substrate temperature controlled at −10° C. was fabricated except that the titanyl phthalocyanine film was immersed in acetic acid/$H_2O$=1:1 (by volume) at 53° C. over 1 hour period. The thin film XRPD pattern showed a diffraction peak at approximately 27.3° 2θ.

EXAMPLE IX

Acetic Acid/$H_2O$ Solvent Treatment:

An electrophotographic photoreceptor similar to the one in Example IV was fabricated except the photogenerator layer was immersed in acetic acid/$H_2O$=1:1 (by volume) at 45° C. over a 1 hour period. The optical absorption spectrum showed a Type IV titanyl phthalocyanine. After rinsing with water and drying in ambient conditions, the amine charge transport layer was then coated onto the above prepared photogenerator layer. The xerographic electrical properties of the photoresponsive member was tested according to the procedure of Example IV. The photosensitivity results with monochromatic light (800 nanometers) are summarized in Table 2.

EXAMPLE X

Acetone/$H_2O$ Treatment:

A film similar to the one in Example VII with the substrate temperature controlled at −10° C. was fabricated except that titanyl phthalocyanine film was immersed in 100 milliliters of 1:1 by volume of acetone/$H_2O$ mixture containing 0.25 milliliter of HCl at 53° C. for 1 hour. The XRPD pattern of the thin film product showed a Bragg angle $2\theta$ peak at approximately 27.3°.

EXAMPLE XI

Acetone/$H_2O$ Treatment:

An electrophotographic photoreceptor of Example IV was fabricated except that the photogenerator layer was immersed in 100 milliliters of 1:1 by volume of acetone/$H_2O$ mixture containing 0.25 milliliter of HCl at 45° C. for 1 hour. The optical absorption spectrum evidenced a Type IV titanyl phthalocyanine. After rinsing with water and drying at 25° C., the amine charge transport layer was then coated onto the above prepared photogenerator layer. The xerographic electrical properties of the photoresponsive members were tested according to the procedure of Example IV. The photosensitivity results with monochromatic light (800 nanometers) are summarized in Table 2.

TABLE 1

| EXAMPLE | TiOPc Purification | Substrate Temperature (C.°) | Solvent Treatment | Dark Decay (v/s) | % Discharge @ 5 ergs/cm² | % Discharge @ 10 | $E_{\frac{1}{2}}$ (ergs/cm²) |
|---|---|---|---|---|---|---|---|
| Example IV | Train | −30 | MeOH | 34 | 85 | 88 | 0.8 |
| Example VI | Sublimed | 0 | | 28 | 85 | 87 | 0.8 |
| Comparative Example I | | 25 | | 30 | 81 | 84 | 1.3 |
| Comparative Example II | | 90 | | 35 | 74 | 86 | 2.6 |

TABLE 2

| EXAMPLE | TiOPc Purification | Substrate Temperature (C.°) | Solvent Treatment | Dark Decay (v/s) | % Discharge @ 5 ergs/cm² | % Discharge @ 10 | $E_{\frac{1}{2}}$ (ergs/cm²) |
|---|---|---|---|---|---|---|---|
| IX | Train Sublimed | −30 | Acetic Acid/$H_2O$ = 1:1 (by volume) | 49 | 61 | 75 | 1.1 |
| XI | Train Sublimed | −30 | Acetic Acid/$H_2O$ = 1:1 (by volume) | 25 | 63 | 68 | 1.8 |

Other modifications of the present invention may occur to those skilled in the art subsequent to a review of the present application, and these modifications, including equivalents thereof, are intended to be included within the scope of the present invention.

What is claimed is:

1. A layered imaging member comprised of a photogenerating layer of titanyl phthalocyanine prepared by depositing amorphous titanyl phthalocyanine on a substrate maintained at a temperature of from below 25° to about minus 30° C. for a period of time until the deposition process is completed; and contacting the substrate product with an aliphatic alcohol.

2. A process for the preparation of titanyl phthalocyanine consisting essentially of depositing amorphous titanyl phthalocyanine on a substrate maintained at a temperature of from below 25° to about minus 30° C. for a period of time until the deposition process is completed; and contacting the substrate product with an aliphatic alcohol.

3. A process for the preparation of titanyl phthalocyanine consisting essentially of depositing amorphous titanyl phthalocyanine on a substrate maintained at a temperature of from below 25° to about minus 30° C. for a period of time until the deposition process is completed; subsequently permitting the aforementioned substrate product to attain room temperature; and thereafter contacting the substrate product with an alkylalcohol.

4. A process for the preparation of titanyl phthalocyanine consisting essentially of depositing amorphous titanyl phthalocyanine on a substrate maintained at a temperature of from below 25° to about minus 30° C. for a period of time until the deposition process is completed; subsequently permitting the aforementioned substrate product to attain room temperature; and thereafter contacting the substrate product with a ketone, a ketone/water mixture or a ketone/water mixture containing an acid.

5. A process for the preparation of titanyl phthalocyanine Type IV consisting essentially of depositing amorphous titanyl phthalocyanine on a substrate maintained at a temperature of from below 25° to about minus 30° C. for a period of time until the deposition process is completed; subsequently permitting the aforementioned substrate product to attain room temperature; and thereafter contacting the substrate product with an acid or acid/water mixture.

6. A process in accordance with claim 2 wherein the amorphous titanyl phthalocyanine is titanyl phthalocyanine Type I or Type II, the substrate is maintained at −30° C., the titanyl phthalocyanine obtained is titanyl phthalocyanine Type IV, and said aliphatic alcohol is methanol.

7. A process in accordance with claim 2 wherein the substrate is maintained at a temperature of from below 25° to about minus 30° C. by liquid nitrogen.

8. A process in accordance with claim 2 wherein the substrate is a metal, glass or quartz.

9. A process in accordance with claim 2 wherein the substrate is aluminum.

10. A process in accordance with claim 2 wherein the substrate is comprised of metallized plastics.

11. A process in accordance with claim 2 wherein the temperature is about 25° C.

12. A process in accordance with claim 1 wherein the substrate is maintained at a temperature of minus 30° C.

13. A process in accordance with claim 2 wherein the substrate is maintained at a temperature of from about minus 10° to about minus 30° C.

14. A process in accordance with claim 2 wherein the substrate product is maintained at room temperature for from about 2 minutes to about 2 hours.

15. A process in accordance with claim 1 wherein the contacting of the substrate product is accomplished by the immersion thereof in the alcohol.

16. A process in accordance with claim 1 wherein the contacting of the substrate product is accomplished by the vapor exposure thereof in the alcohol.

17. A process in accordance with claim 2 wherein the contacting of the substrate product is accomplished by the immersion thereof in the alcohol for a period of time of from about 2 seconds to about 2 hours at temperatures from 25° to 70° C.

18. A process in accordance with claim 2 wherein the alkyl group of the alcohol contains from 1 to about 10 carbon atoms.

19. A process in accordance with claim 2 wherein the alcohol is methanol.

20. A process in accordance with claim 4 wherein the ketone/water mixture is acetone/water of a ratio of 1:1 (in volume).

21. A process in accordance with claim 2 wherein the substrate product after contacting with said alcohol is comprised of titanyl phthalocyanine Type :IV with a purity of from between about 95 to about 99.5 percent.

22. A process in accordance with claim 19 wherein the substrate product after contacting with said methanol is comprised of titanyl phthalocyanine Type IV with a purity of from between about 95 to about 99.5 percent.

23. A process in accordance with claim 2 wherein the deposition is accomplished with a train sublimed titanyl phthalocyanine.

24. A process in accordance with claim 2 wherein the substrate is cooled to a temperature of from about −10° to about −30° C., thereafter permitting the substrate to obtain a temperature of about 25° C., and wherein said aliphatic alcohol is methanol.

* * * * *